US011022070B2

(12) United States Patent
Aumann et al.

(10) Patent No.: US 11,022,070 B2
(45) Date of Patent: Jun. 1, 2021

(54) DEVICE AND METHOD FOR STANDARDISATION AND FOR CONSTRUCTION OF AN ORC CONTAINER

(71) Applicant: ORCAN ENERGY AG, Munich (DE)

(72) Inventors: Richard Aumann, Munich (DE); Fabian Weigand, Munich (DE)

(73) Assignee: ORGAN ENERGY AG, Munich (DE)

( * ) Notice: Subject to any disclaimer, the term of this patent is extended or adjusted under 35 U.S.C. 154(b) by 5 days.

(21) Appl. No.: 16/613,599

(22) PCT Filed: Apr. 20, 2018

(86) PCT No.: PCT/EP2018/060182

§ 371 (c)(1),
(2) Date: Nov. 14, 2019

(87) PCT Pub. No.: WO2018/210528

PCT Pub. Date: Nov. 22, 2018

(65) Prior Publication Data

US 2020/0200123 A1 Jun. 25, 2020

(30) Foreign Application Priority Data

May 15, 2017 (EP) ..... 17170986

(51) Int. Cl.
*F02G 5/02* (2006.01)
*F01K 23/06* (2006.01)
(Continued)

(52) U.S. Cl.
CPC ..... *F02G 5/02* (2013.01); *F01K 23/065* (2013.01); *F01K 25/08* (2013.01); *F01N 5/02* (2013.01);
(Continued)

(58) Field of Classification Search
CPC ..... F01K 13/00; F01K 23/065; F01K 23/10; F01K 25/08; F01N 2240/02; F01N 5/02; F02G 2260/00; F02G 5/02; Y02T 10/12
See application file for complete search history.

(56) References Cited

U.S. PATENT DOCUMENTS 6,952,924 B2 * 10/2005 Tsutsui ..... B01D 5/0093 60/645
7,637,108 B1 * 12/2009 Langson ..... F01K 23/065 60/616

(Continued)

FOREIGN PATENT DOCUMENTS

| | | | |
|---|---|---|---|
| CN | 204661610 | U | 9/2015 |
| EP | 2955340 | A1 | 12/2015 |
| NO | 2016055263 | A1 | 4/2016 |

OTHER PUBLICATIONS

Intention to Grant issued by the European Patent Office for application No. 17170986.8-1007, dated Sep. 7, 2020.

(Continued)

*Primary Examiner* — Jesse S Bogue
(74) *Attorney, Agent, or Firm* — Moore & Van Allen PLLC; Henry B. Ward, III

(57) ABSTRACT

The present invention discloses an ORC container comprising the following components: a container, in particular an ISO container, having arranged therein an ORC device for converting heat energy into electrical or mechanical energy, wherein the ORC device comprises a working medium; a heat introduction device provided on the ISO container and used for supplying heat energy from an aggregate container; and a spacer device arranged on the container, wherein the spacer device is suitable for providing an intermediate space between the ORC container and the aggregate container. The present invention additionally relates to a system comprising (Continued)

an ORC container and an aggregate container as well as to a method for installing such a system.

19 Claims, 1 Drawing Sheet

(51) Int. Cl.
*F01K 25/08* (2006.01)
*F01N 5/02* (2006.01)

(52) U.S. Cl.
CPC ..... *F01N 2240/02* (2013.01); *F02G 2260/00* (2013.01)

(56) References Cited

U.S. PATENT DOCUMENTS 8,146,360 B2 * 4/2012 Myers ..... F02C 1/05 60/618
8,336,311 B2 * 12/2012 Ogino ..... F01K 7/16 60/670
9,291,074 B2 * 3/2016 Nagai ..... F01K 23/18
9,328,632 B2 * 5/2016 Nagai ..... F01K 23/065
9,745,887 B2 * 8/2017 Honda ..... F01K 5/02
2012/0111004 A1 5/2012 Conry
2015/0361831 A1 * 12/2015 Myers ..... F01K 23/101 60/645

OTHER PUBLICATIONS

Extended European Search Report issued by the European Patent Office for European Patent Application No. 17170986.8 dated Nov. 15, 2017.
International Search Report issued by the European Patent Office for International Patent Application No. PCT/EP2018/060182 dated Jun. 21, 2018.
Written Opinion issued by the European Patent Office for International Patent Application No. PCT/EP2018/060182 dated Jun. 21, 2018.
Examination Report Issued by the Intellectual Property Office of India for Indian Application No. 201947051219, dated Mar. 10, 2021.

* cited by examiner

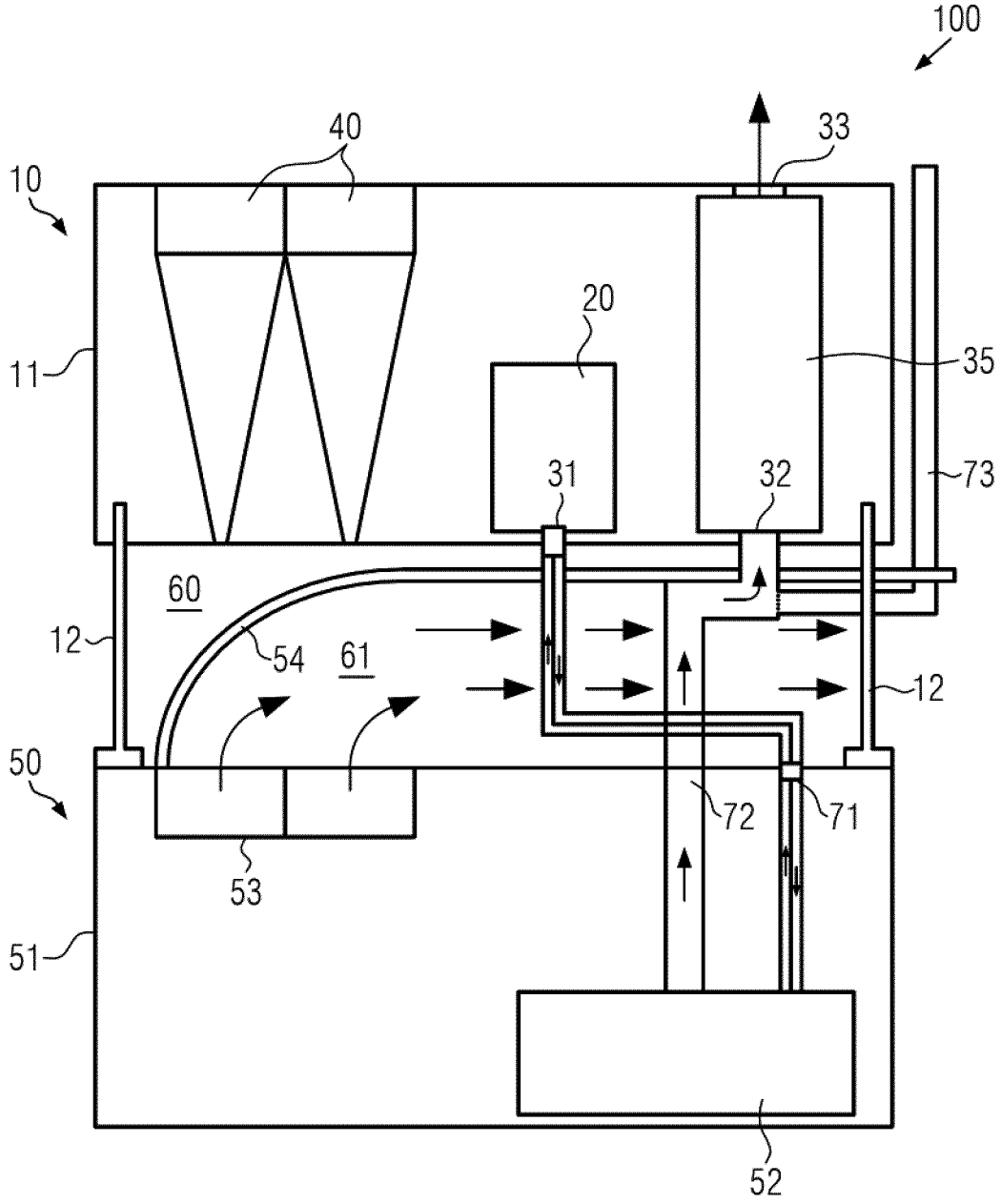
100
40
33
10
20
11
35
31
32
73
60
12
54
61
12
50
72
71
53
51
52

DEVICE AND METHOD FOR STANDARDISATION AND FOR CONSTRUCTION OF AN ORC CONTAINER

FIELD OF THE INVENTION

The present invention relates to an ORC container, a system comprising an ORC container and an aggregate container as well as to a method for installing such a system.

PRIOR ART

Some of the few remaining economic solutions for increasing the efficiency of internal combustion engines with great potential is the utilization of waste heat by means of a thermal cycle (e.g. an Organic Rankine Cycle System, ORC system) so as to generate electrical energy with a generator of the ORC system, by way of example.

In this context, it will make sense to integrate a complete module, consisting e.g. of an ORC system, an exhaust gas heat exchanger (EGHE), a recooling unit and a control cabinet, into an ISO container, so as to achieve maximum standardization for transport (e.g. sending by ship or truck). Since also internal combustion engines are frequently installed in standardized containers, the person skilled in the art is therefore confronted with the task of positioning these containers in the best possible way in relation to one another.

DESCRIPTION OF THE INVENTION

The present invention provides a solution of the posed task.

The solution according to the present invention is defined by an ORC container having the features according to claim 1.

Hence, the present invention discloses an ORC container comprising the following components: a container, in particular an ISO container, having arranged therein an ORC device for converting heat energy into electrical or mechanical energy, wherein the ORC device comprises a working medium; a heat introduction device provided on the ISO container and used for supplying heat energy from an aggregate container; and a spacer device arranged on the container, wherein the spacer device is suitable for providing an intermediate space between the ORC container and the aggregate container. The working medium may comprise a mixture of a plurality of components and/or may contain an additive, such as a lubricant.

The ORC container according to the present invention is advantageous insofar as the intermediate space can be used for elements that are required for thermal coupling.

The ORC container according to the present invention can be further developed insofar as the spacer device comprises a stand device for installing the ORC container on the aggregate container, whereby the intermediate space between a lower surface of the ORC container and an upper surface of the aggregate container is provided, the stand device comprising in particular standardized connection elements, preferably standardized corner joints (so-called corner castings).

The ORC container according to the present invention comprising the stand device has the advantages that, making use of the stand device, the ORC container can be placed on the aggregate container, whereby less space will be occupied, and, in addition, that the intermediate space can be used for elements which are necessary for thermal coupling.

This allows in particular the use of a standardized structural design of the ORC container for various aggregate containers.

The heat introduction device may be provided on the lower surface, on a lateral surface or on the upper surface of the ORC container.

The ORC container according to the present invention may be further developed insofar as the heat introduction device may comprise a connection device for supplying and discharging a heat-carrying liquid, the heat-carrying liquid in the ORC container being supplyable to a preheater and/or an evaporator of the ORC device by means of an arrangement of pipes, so as to transfer heat energy from the liquid to the working medium. This connection device may, for example, comprise connection pieces for a pipe or hose connection.

Another further development is to be seen in that the heat introduction device comprises an exhaust gas inlet for supplying a heat-carrying exhaust gas to an exhaust gas heat exchanger of the ORC device, so as to transfer heat from the exhaust gas to a further heat-carrying medium and, subsequently, from the latter to the working medium, or directly to the working medium, in particular for preheating and/or evaporating the working medium, and wherein the ORC container additionally comprises an exhaust gas outlet, in particular at the top of the ISO container. Also the exhaust gas inlet may, for example, comprise a connection piece for a pipe connection or for the purpose of fixing guide plates.

According to another further development, the stand device comprises one or a plurality of supporting feet, which are adapted to be extended and retracted and/or to be folded out and folded in and/or which are releasably fixed.

Each extendable and retractable supporting foot may here comprise an outer member and an extendable and retractable inner member, and a fixing device may be provided fixing an extension of the inner member from the outer member.

The intermediate space may have arranged therein a bypass conduit for discharging excess exhaust gas.

The above-mentioned task is also solved by a system according to claim 9.

The system according to the present invention comprises: an ORC container according to the present invention or an ORC container according to one of the above-mentioned further developments; and an aggregate container comprising an aggregate which generates heat during operation, the aggregate container comprising a heat extraction device arranged preferably at the top of the aggregate container and used for discharging heat from the aggregate container.

The system according to the present invention can be further developed insofar as the aggregate container comprises a further ISO container, in which the aggregate is arranged, wherein the further ISO container has the same dimensions as the ISO container of the ORC container. In this way, it is guaranteed that the containers can be placed one on top of the other in a safe and reliable manner.

According to another further development, the aggregate may comprise an internal combustion engine, wherein the heat-carrying liquid is a coolant of the internal combustion engine, and the aggregate container has a connection device arranged at the top of the aggregate container and used for discharging and supplying the coolant, and wherein the heat-carrying exhaust gas is an exhaust gas of the internal combustion engine and the aggregate container has an exhaust gas outlet arranged at the top of the aggregate container and used for discharging the exhaust gas.

Another further development is to be seen in that the intermediate space has provided therein a bypass conduit for discharging excess exhaust gas.

According to another further development, the heat extraction device of the aggregate container and the heat introduction device of the ORC container may be releasably connected by means of one or a plurality of connection elements, the connection elements being arranged in the intermediate space.

Another further development is to be seen in that one or a plurality of releasably arranged deflection elements may be provided in the intermediate space so as to conduct cooling air of the aggregate away from an area of the ORC container in which a radiator of the ORC device is arranged. In this way, the efficiency of the ORC cooling (recooling) can be guaranteed.

The above-mentioned task is also solved by a method according to claim 14.

The method according to the present invention used for installing a system according to the present invention comprises the following steps: attaching and/or extending and/or folding out the stand device on the ORC container; placing the ORC container onto the aggregate container; and connecting the heat extraction device of the aggregate container to the heat introduction device of the ORC container.

The method according to the present invention can be further developed insofar as a step of fixing the above-mentioned deflection elements in position in the intermediate space between the ORC container and the aggregate container may be provided.

The above-mentioned further developments may be used individually or, as claimed, they may be combined in a suitable manner.

Further features and exemplary embodiments as well as advantages of the present invention will be explained in more detail hereinafter making reference to the drawings. It goes without saying that the embodiments do not exhaust the scope of the present invention. In addition, it goes without saying that some of the features or all the features described hereinafter may also be combined with one another in some other way.

DRAWINGS

FIG. 1 shows an embodiment of the system according to the present invention.

EMBODIMENTS

FIG. 1 shows a system with an ORC container 10 and an aggregate container 50.

The ORC container 10 comprises an ISO container 11 having an ORC device 20 arranged therein for converting heat energy into electrical energy; a heat introduction device 31, 32 provided on a lower surface of the ISO container and used for supplying heat energy from the aggregate container 50; and a stand device 12 arranged on the ISO container 11, the stand device 12 being suitable for installing the ORC container 10 on the aggregate container 50 and for providing an intermediate space 60 between the lower surface of the ORC container 10 and an upper surface of the aggregate container 50. In the present example, the aggregate container 50 is an engine container 50 with an internal combustion engine 52. The internal combustion engine 52 generates heat when in operation. The heat from the coolant of the internal combustion engine 52 and from the exhaust gas of the internal combustion engine 52 is used in the ORC-System 20 for generating energy.

To this end, the heat introduction device 31, 32 has a connection device 31 for supplying and discharging the coolant, the coolant being supplied in the ORC container 10 to a preheater and/or an evaporator of the ORC device 20 by means of an arrangement of pipes, so as to transfer heat energy from the coolant to the working medium.

The heat introduction device 31, 32 further comprises an exhaust gas inlet 32 for supplying the exhaust gas to an exhaust gas heat exchanger 35 of the ORC device 20. Heat is here transferred from the exhaust gas to the working medium and used to preheat the working medium (upstream of the evaporator). The ORC container 10 also has an exhaust gas outlet 33 at the top of the ISO container 11.

Heat transfer to the working medium may take place directly, i.e. direct evaporation or preheating via a heat exchanger, or through an intermediate circuit with a further heat carrier medium.

Preferably, also the aggregate container comprises an ISO container 51. The aggregate container 50 comprises a heat extraction device 71, 72 arranged at the top of the aggregate container 50 and used for discharging heat from the aggregate container 50. The heat-carrying liquid is the coolant ("cooling water") of the internal combustion engine 52, and the aggregate container 50 has at its top a connection device 71 for discharging and supplying the coolant. In addition, the heat-carrying exhaust gas is here the exhaust gas of the internal combustion engine 52 and the aggregate container 50 has an exhaust gas outlet 72 arranged at the top of the aggregate container and used for discharging the exhaust gas.

The underlying problem and its solution will be explained once more hereinafter.

According to the present invention, it is suggested to place the ORC container 10 on top of the aggregate container 50, so as to reduce the space required (footprint) and so as to position, at the same time, the ORC system as close as possible to the heat source. A connection may here be established via standardized connecting elements, e.g. corner castings.

In so doing, it must, however, be taken into account that the radiator 53 belonging to the internal combustion engine generates heated air and often has an upwardly directed exhaust air duct, which must not be covered.

If this exhaust air is sucked in through the radiator 40 of the ORC system 20, this will also have a negative effect on the ORC process (lower gross output and higher auxiliary power requirement resulting in a reduced net output). Therefore, the container above would have to be provided with an opening allowing the exhaust air to pass through, which means that less container area would be available for the ORC system. In addition, a standardization of the ORC container would be rendered more difficult because the engine-side exhaust air duct leading out of the engine container will not necessarily always be arranged at the same point. Furthermore, problems arise with respect to the structural design and the installation of the (pipe) lines for the supply of engine exhaust gas and engine cooling water from the engine to the ORC system. If the two containers are positioned directly on top of each other (without the intermediate space 60), there will be no space therebetween and mounting for the purpose of joining the respective connections will be considerably more difficult. In addition, the position of the connections varies in the case of engines and, if the connections leading out of/into the container are not located directly one above the other, a bypass will be necessary. The latter would then have to be realized within the ORC container, which, in turn, would reduce the area available for the ORC system within the container and thus reduce the flexibility. A reduction of the space available in the container also results in a reduction of the radiator area and/or the exhaust gas heat transfer area. If these respective areas are located below the specific design point, this will have performance-reducing effects and thus be detrimental to the economic efficiency of the system.

According to the present invention, these drawbacks are overcome by the intermediate space 60 between the two containers 10, 50.

The ORC container 10 is provided with extendable or detachable feet 12, which create the intermediate space 60 to the aggregate container 50 located therebelow. This allows the above described problems to be solved:

The entire container volume is available for the ORC system.

The exhaust air duct 61 for the radiator of the engine container located below is flexible (representable e.g. by means of baffle plates 54) in the intermediate space 60 and warm air can be discharged as required.

A standardized transport with retracted feet is still possible.

The stability for transport with stackability according to relevant guidelines (e.g. CSC) is maintained through the standard container (ISO container) (feet retracted).

A flexible connection of the engine cooling water and the exhaust gas can be accomplished by pipe routing in the intermediate space (also a bypass, bypass conduit 73 for the discharge of excess exhaust gas).

The highest point of the engine cooling water connection is located inside the ORC container. This allows a standardized installation of vents during production and thus reduces the installation effort on site.

Further simplifications for use result from fixed connection points in the ORC container in combination with standard plug-in components for the exhaust pipe (elbows, T-pieces) or the engine cooling water (e.g. hoses with quick couplers), which, when the container is transported, can also be supplied as additional components in the free container volume of the ORC container.

The following advantages are particularly worth mentioning. The ISO-container with additional supporting feet is a standard product without changes in design and manufacturing. Only minor adjustments will be necessary during installation (connecting the ORC container to the aggregate container). In addition, there is flexibility as regards installation and pipe routing instead of the necessity of determining a specific combination in advance. The ORC container may already contain external installation components in the available volume—no further logistics are required. A maximized installation space can be used in the ORC container. Exhaust air routing can be accomplished on a side facing away from the radiators of the ORC container.

The embodiments shown are only of an exemplary nature and the entire scope of the present invention is defined by the claims.

The invention claimed is:

1. An ORC container for use with an aggregate container, comprising:

a container having arranged therein an ORC device for converting heat energy into electrical or mechanical energy, wherein the ORC device comprises a working medium;

a heat introduction device provided at the container and used for supplying heat energy from the exhaust gas from an aggregate container;

a spacer device arranged on the container, wherein the spacer device is suitable for providing an intermediate space between the ORC container and the aggregate container; and a bypass conduit for discharging excess exhaust gas, the bypass conduit being provided in the intermediate space.

2. The ORC container according to claim 1, wherein the spacer device comprises a stand device for installing the ORC container on the aggregate container, whereby the intermediate space between a lower surface of the ORC container and an upper surface of the aggregate container is provided, the stand device comprising in particular standardized connection elements, preferably standardized corner joints.

3. The ORC container according to claim 1, wherein the heat introduction device is provided on the lower surface or on a lateral surface of the ORC container.

4. The ORC container according to claim 1, wherein the heat introduction device comprises a connection device for supplying and discharging a heat-carrying liquid, the ORC container comprising an arrangement of pipes for supply the heat-carrying liquid in the ORC container to at least one selected from the group comprising a preheater and an evaporator of the ORC device, so as to transfer heat energy from the liquid to the working medium.

5. The ORC container according to claim 1, further comprising:

wherein the ORC device comprises an exhaust gas heat exchanger; and wherein the heat introduction device comprises an exhaust gas inlet for supplying a heat-carrying exhaust gas to the exhaust gas heat exchanger of the ORC device, so as to transfer heat from the exhaust gas directly to the working medium or to a further heat-carrying medium and, subsequently, from the latter to the working medium, for at least one selected from the group comprising preheating and evaporating the working medium, and wherein the ORC container additionally comprises an exhaust gas outlet at the top of the container.

6. The ORC container according to claim 2, wherein the stand device comprises supporting feet, which are adapted to be at least one selected from the group comprising (i) extended and retracted, (ii) folded out and folded in, and (iii) releasably fixed.

7. The ORC container according to claim 6, wherein each extendable and retractable supporting foot comprises an outer member and an extendable and retractable inner member, and wherein a fixing device is provided for fixing an extraction of the inner member from the outer member.

8. A system comprising:

an aggregate container comprising an aggregate which generates heat during operation, the aggregate container comprising a heat extraction device arranged at the top of the aggregate container, and used for discharging heat from the aggregate container; and an ORC container comprising:

a container having arranged therein an ORC device for converting heat energy into electrical or mechanical energy, wherein the ORC device comprises a working medium;

a heat introduction device provided at the container and used for supplying heat energy from the exhaust gas from an aggregate container;

a spacer device arranged on the container, wherein the spacer device is suitable for providing an intermediate space between the ORC container and the aggregate container; and a bypass conduit for discharging excess exhaust gas, the bypass conduit being provided in the intermediate space.

9. The system according to claim 8, wherein the aggregate container comprises a further container in which the aggregate is arranged, wherein the further container preferably has the same dimensions as the container of the ORC container, and wherein the further container preferably comprises standardized connection elements, which are connectable to standardized connection elements of the ORC container.

10. The system according to claim 8, wherein the aggregate container comprises an internal combustion engine, wherein the heat-carrying liquid is a coolant of the internal combustion engine, and the aggregate container has a connection device arranged at the top of the aggregate container and used for discharging and supplying the coolant, and wherein the heat-carrying exhaust gas is an exhaust gas of the internal combustion engine and the aggregate container has an exhaust gas outlet arranged at the top of the aggregate container and used for discharging the exhaust gas.

11. The system according to claim 8, wherein the heat extraction device of the aggregate container and the heat introduction device of the ORC container are releasably connected by one or a plurality of connection elements, which are arranged in the intermediate space.

12. The system according to claim 8, wherein the ORC device comprises a radiator; and wherein one or a plurality of releasably arranged deflection elements are provided in the intermediate space, so as to lead cooling air of the aggregate container away from an area of the ORC container in which the radiator of the ORC device is arranged.

13. A method for installing a system, the method comprising the following steps:

providing a system comprising:

an aggregate container comprising an aggregate which generates heat during operation, the aggregate container comprising a heat extraction device arranged at the top of the aggregate container, and used for discharging heat from the aggregate container; and an ORC container comprising:

a container having arranged therein an ORC device for converting heat energy into electrical or mechanical energy, wherein the ORC device comprises a working medium;

a heat introduction device provided at the container and used for supplying heat energy from the exhaust gas from an aggregate container;

a spacer device arranged on the container, wherein the spacer device is suitable for providing an intermediate space between the ORC container and the aggregate container; and a bypass conduit for discharging excess exhaust gas, the bypass conduit being provided in the intermediate space;

at least one of the group comprising: (i) attaching; (ii) extending; and (iii) folding out the stand device on the ORC container;

placing the ORC container onto the aggregate container; and connecting the heat extraction device of the aggregate container to the heat introduction device of the ORC container.

14. The method a claim 12, further comprising the step of:

fixing the deflection elements in position in the intermediate space between the ORC container and the aggregate container.

15. The ORC container according to claim 2, wherein the heat introduction device is provided on the lower surface or on a lateral surface of the ORC container.

16. The ORC container according to claim 2, wherein the heat introduction device comprises a connection device for supplying and discharging a heat-carrying liquid, the ORC container comprising an arrangement of pipes for supply the heat-carrying liquid in the ORC container to at least one selected from the group comprising a preheater and an evaporator of the ORC device, so as to transfer heat energy from the liquid to the working medium.

17. The ORC container according to claim 2, further comprising:

wherein the ORC device comprises an exhaust gas heat exchanger; and wherein the heat introduction device comprises an exhaust gas inlet for supplying a heat-carrying exhaust gas to the exhaust gas heat exchanger of the ORC device, so as to transfer heat from the exhaust gas directly to the working medium or to a further heat-carrying medium and, subsequently, from the latter to the working medium, for at least one selected from the group comprising preheating and evaporating the working medium, and wherein the ORC container additionally comprises an exhaust gas outlet at the top of the container.

18. The ORC container according to claim 15, wherein the stand device comprises supporting feet, which are adapted to be at least one selected from the group comprising (i) extended and retracted, (ii) folded out and folded in, and (iii) releasably fixed.

19. The system according to claim 8, wherein the heat introduction device comprises a connection device for supplying and discharging a heat-carrying liquid, the ORC container comprising an arrangement of pipes for supply the heat-carrying liquid in the ORC container to at least one selected from the group comprising a preheater and an evaporator of the ORC device, so as to transfer heat energy from the liquid to the working medium;

wherein the ORC device comprises an exhaust gas heat exchanger; and wherein the heat introduction device comprises an exhaust gas inlet for supplying a heat-carrying exhaust gas to the exhaust gas heat exchanger of the ORC device, so as to transfer heat from the exhaust gas directly to the working medium or to a further heat-carrying medium and, subsequently, from the latter to the working medium, for at least one selected from the group comprising preheating and evaporating the working medium, and wherein the ORC container additionally comprises an exhaust gas outlet at the top of the container.

* * * * *